US008876029B2

(12) United States Patent
Ma et al.

(10) Patent No.: US 8,876,029 B2
(45) Date of Patent: Nov. 4, 2014

(54) GRINDING DISK FOR FOOD WASTE DISPOSER

(75) Inventors: Huaxun Ma, Zhangzhou (CN); Lei Sun, Zhangzhou (CN)

(73) Assignee: Xiamen Sunwise Environmental Protection Co., Ltd., Xiamen, Fujian (CN)

( * ) Notice: Subject to any disclaimer, the term of this patent is extended or adjusted under 35 U.S.C. 154(b) by 0 days.

(21) Appl. No.: 13/880,165

(22) PCT Filed: Nov. 4, 2011

(86) PCT No.: PCT/CN2011/081772

§ 371 (c)(1), (2), (4) Date: Apr. 18, 2013

(87) PCT Pub. No.: WO2012/088957

PCT Pub. Date: Jul. 5, 2012

(65) Prior Publication Data

US 2013/0277475 A1 Oct. 24, 2013

(30) Foreign Application Priority Data

Dec. 31, 2010 (CN) ..... 2010 2 0697710 U

(51) Int. Cl.

| | |
|---|---|
| ***B02C 23/36*** | (2006.01) |
| ***B02C 13/28*** | (2006.01) |
| ***B02C 19/00*** | (2006.01) |
| ***B02C 13/18*** | (2006.01) |

(52) U.S. Cl.

CPC ..... *B02C 13/2804* (2013.01); *B02C 19/0012* (2013.01); *B02C 13/1814* (2013.01)

USPC ..... 241/46.013

(58) Field of Classification Search

USPC ..... 241/46.013, 46.014

See application file for complete search history.

(56) References Cited

U.S. PATENT DOCUMENTS

| | | | | |
|---|---|---|---|---|
| 7,337,996 | B2 * | 3/2008 | Hanson et al. | 241/46.013 |
| 7,360,729 | B2 * | 4/2008 | Anderson et al. | 241/46.013 |
| 7,500,628 | B2 * | 3/2009 | Berger et al. | 241/46.013 |
| 7,651,041 | B2 * | 1/2010 | Wu | 241/46.013 |
| 7,735,760 | B2 * | 6/2010 | Hanson et al. | 241/46.013 |
| 2008/0116305 | A1 * | 5/2008 | Hanson et al. | 241/46.013 |

* cited by examiner

*Primary Examiner* — Faye Francis

(57) ABSTRACT

A grinding disk used for a food waste disposer includes a knocking disk base, a long strip knocking plate, at least two knocking blocks and rivets. The long strip knocking plate is arranged on the lower surface of the knocking disk base. The knocking blocks are movably and symmetrically mounted to the knocking disk base via the rivets, and each knocking block includes a cushion block for connection of the rivets and a knocking block head pivotally connected to the cushion block. When the knocking disk base is rotated with the shaft of an electric motor, the cushion block of the knocking block drives the knocking block head to slide, such that the knocking block head rotates about the rivet to hammer an object, and the cushion block can also move up and down and hammer the object while rotating and sliding.

3 Claims, 3 Drawing Sheets

GRINDING DISK FOR FOOD WASTE DISPOSER

BACKGROUND OF THE INVENTION

1. Field of the Invention

The present invention relates to a food waste disposer, and more particularly to a grinding disk used for a food waste disposer.

2. Description of the Prior Art

A conventional disposer on the market comprises a transmission rod, hammer rods, a hammer and a pin shaft. The transmission rod is provided with interlaced hammer rods in a radial direction. The hammer is connected to the other end of the hammer rod via the pin shaft. This structure is simple and convenient for replacement of the wear and tear hammer. However, this structure is larger in size and not adapted for a small disposer.

An improved grinding disk structure used for a food waste disposer is developed, such as Chinese Patent application No. 200920183462.6. As shown in FIG. 1, the grinding disk structure comprises knocking blocks 1', a disk base 2', a long strip knocking plate 3', and rivets 4'. The long strip knocking plate 3' is arranged on the lower surface of the disk base 2'. The knocking blocks 1' are movably and symmetrically mounted to the disk base 2' via the rivets 4'. When the disk base 2' is rotated with the shaft of an electric motor, the knocking blocks 1' slide on the disk base 2' and the knocking blocks 1' rotates about the rivets 4' to hammer an object.

In aforesaid grinding disk structure, the knocking blocks 1' are movably connected to the disk base 2' via the rivets 4'. Along with turning of the disk base 2', the knocking blocks 1' rotates about the rivets 4' to hammer an object. When tiny debris like a tiny stone or bone is stuck in the gap between the knocking blocks 1' and the disk base 2' along with turning, the knocking blocks 1' are unable to slide and rotate to hammer the object so that the working of the knocking blocks 1' is influenced. Therefore, the food waste disposer must be dismantled for cleaning and maintenance.

Accordingly, the inventor of the present invention has devoted himself based on his many years of practical experiences to solve these problems.

SUMMARY OF THE INVENTION

The primary object of the present invention is to provide a grinding disk used for a food waste disposer so that the tiny debris will not become stuck in the gap between knocking blocks and a knocking disk base.

In order to achieve the aforesaid object, the grinding disk used for a food waste disposer of the present invention comprises a knocking disk base, a long strip knocking plate, at least two knocking blocks and rivets. The long strip knocking plate is arranged on the lower surface of the knocking disk base. The knocking blocks are movably and symmetrically mounted to the knocking disk base via the rivets. Each knocking block comprises a cushion block for connection of the corresponding rivet and a knocking block head pivotally connected to the cushion block.

Preferably, the knocking block head has two connecting blocks extending from two sides of a tail thereof and a pair of pivots on the inner walls of the two connecting blocks, and the cushion block has a pair of pivot holes at a lower end thereof corresponding to the pair of pivots to connect with the cushion block head.

Preferably, the cushion block has a slot for insertion of the corresponding rivet.

When the knocking disk base is rotated with the shaft of an electric motor, the cushion block of the knocking block drives the knocking block head to slide, such that the knocking block head rotates about the rivet to hammer an object, and the cushion block pivotally connected to the cushion block can move up and down and hammer the object while rotating and sliding. When tiny debris falls between the knocking block head and the knocking disk base, the tiny debris can be removed therefrom with the rotation of the knocking disk base, so that the tiny debris will not become stuck in the gap between the knocking block and the knocking disk base to influence the working of the knocking block.

DETAILED DESCRIPTION OF THE PREFERRED EMBODIMENTS

Embodiments of the present invention will now be described, by way of example only, with reference to the accompanying drawings.

Figure 1:
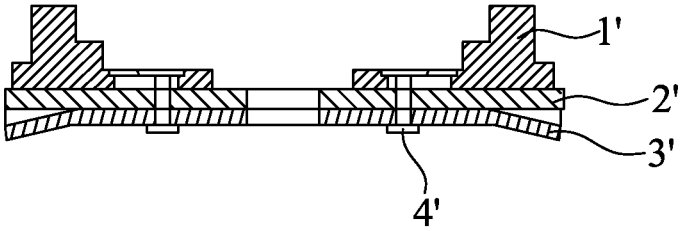
F I G. 1 Prior Art
FIG. 1 is a sectional view of a conventional grinding disk used for a food waste disposer.
Figure 2:
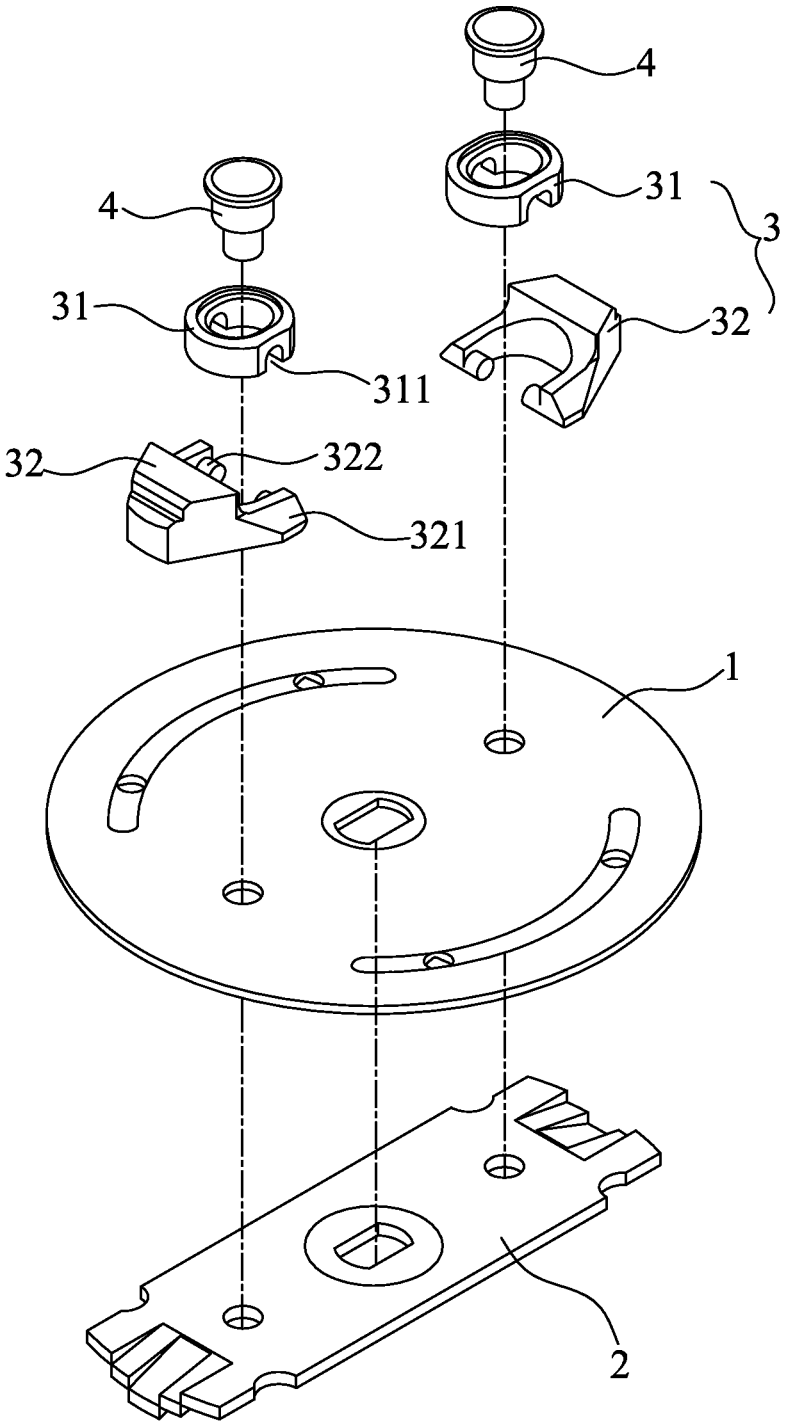
FIG. 2 is an exploded view of the present invention.

As shown in FIG. 2, a grinding disk used for a food waste disposer of the present invention comprises a knocking disk base 1, a long strip knocking plate 2, knocking blocks 3 and rivets 4.

Figure 3:
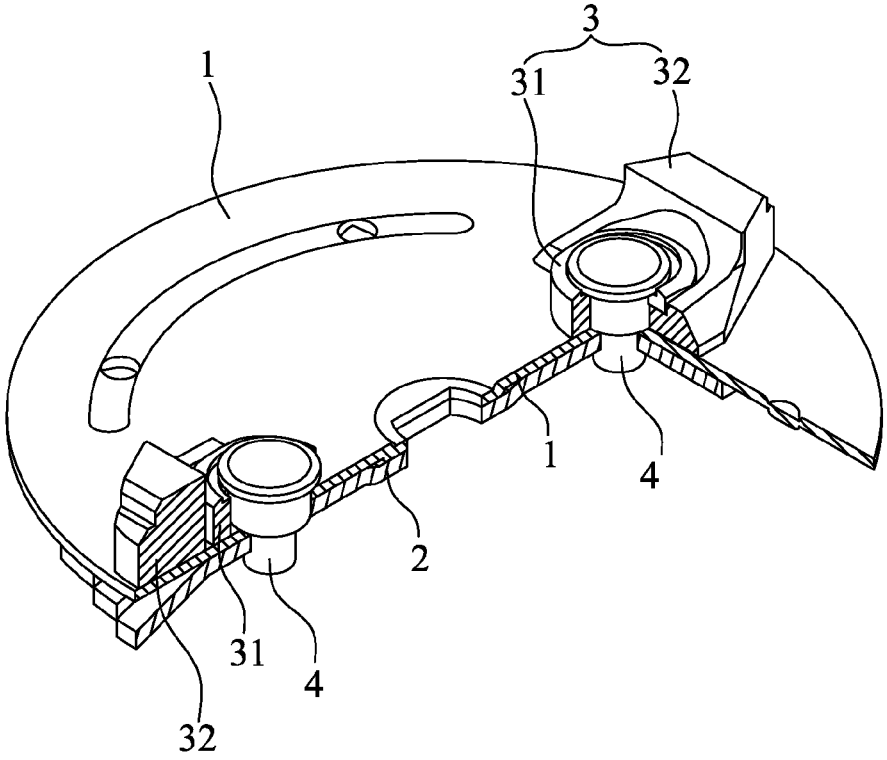
FIG. 3 is a side sectional view of the present invention.

As shown in FIG. 2 and FIG. 3, the long strip knocking plate 2 is arranged on the lower surface of the knocking disk base 1. The two knocking blocks 3 are movably and symmetrically mounted to the knocking disk base 1 via the rivets 4. Each knocking block 3 comprises a cushion block 31 for connection of the corresponding rivet 4 and a knocking block head 32 pivotally connected to the cushion block 31. The knocking block head 32 has two connecting blocks 321 extending from two sides of a tail thereof and a pair of pivots 322 on the inner walls of the two connecting blocks 321. The cushion block 31 has a pair of pivot holes 311 at a lower end thereof corresponding to the pair of pivots 322 to connect with the cushion block head 32, so that the cushion block 31 and the cushion block head 32 form a movable cooperation relationship. Each rivet 4 is inserted through a slot of the cushion block 31 and a fixing hole of the knocking disk base 1, such that the cushion block 31 is movably mounted on the knocking disk base 1.

When the knocking disk base 1 is rotated with the shaft of an electric motor, the cushion block 31 of the knocking block 3 drives the knocking block head 32 to slide, such that the knocking block head 32 rotates about the rivet 4 to hammer an object, and the cushion block 32 pivotally connected to the cushion block 31 can move up and down and hammer the object while rotating and sliding. When tiny debris falls between the knocking block head 32 and the knocking disk base 1, the tiny debris can be removed therefrom with the rotation of the knocking disk base 1, so that the tiny debris will not become stuck in the gap between the knocking block 3 and the knocking disk base 1 to influence the working of the knocking block 3.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A food waste disposer, comprising a knocking disk base, a long strip knocking plate, at least two knocking blocks and rivets, the long strip knocking plate being arranged on a lower surface of the knocking disk base, the knocking blocks being movably and symmetrically mounted to the knocking disk base via the rivets, each knocking block comprising a cushion block for connection of one of the rivets and a knocking block head pivotally connected to the cushion block.

2. The food waste disposer as claimed in claim 1, wherein the knocking block head has two connecting blocks extending from two sides of a tail thereof and a pair of pivots on inner walls of the two connecting blocks, and the cushion block has a pair of pivot holes at a lower end thereof corresponding to the pair of pivots to connect with the cushion block head.

3. The food waste disposer as claimed in claim 1, wherein the cushion block has a slot for insertion of one of the rivets.

* * * * *